US005551264A

United States Patent [19]

Fann et al.

[11] Patent Number: 5,551,264

[45] Date of Patent: Sep. 3, 1996

[54] DOOR LOCK HAVING A DEADBOLT ASSEMBLY WITH A LOW-COST CORROSION-RESISTANT BOLT MEMBER

[75] Inventors: Yaw-Shin Fann, Chia-Yi; San-Yi Lin, Yun-Lin Hsien; Ching-Chuan Kuo; Lan-Kun Don, both of Chia-Yi Hsien; Ming-Shyang Chiou, Chia-Yi, all of Taiwan

[73] Assignee: Tong-Lung Metal Industry Co., Ltd., Taiwan

[21] Appl. No.: 321,611

[22] Filed: Sep. 27, 1994

[51] Int. Cl.[6] ..... E05B 65/06

[52] U.S. Cl. ..... 70/134; 292/1.5; 292/337; 292/DIG. 60; 292/2; 70/461; 70/DIG. 60

[58] Field of Search ..... 292/337, 1.5, 2, 292/169.13, 169.14, DIG. 60, DIG. 44; 70/370, 134, 449, 461, DIG. 60

[56] References Cited

U.S. PATENT DOCUMENTS

| | | | |
|---|---|---|---|
| 4,073,172 | 2/1978 | Schlage | 70/370 |
| 4,143,529 | 3/1979 | Brummett et al. | 292/169.18 |
| 4,338,804 | 7/1982 | Solovieff | 292/337 |
| 4,372,594 | 2/1983 | Gater | 292/1.5 |
| 4,602,490 | 7/1986 | Glass et al. | 70/134 |
| 4,656,849 | 4/1987 | Rotondi et al. | 70/451 |
| 4,895,404 | 1/1990 | Toledano | 292/337 |
| 4,957,315 | 9/1990 | Lin | 292/1.5 |
| 4,976,122 | 12/1990 | Doolan et al. | 70/461 |
| 5,152,558 | 10/1992 | Smith et al. | 292/1.5 |
| 5,433,495 | 7/1995 | Uffner | 292/169.14 |

*Primary Examiner*—Darnell M. Boucher
*Attorney, Agent, or Firm*—Ladas & Parry

[57] ABSTRACT

A door lock includes a deadbolt assembly and a lock housing assembly. The deadbolt assembly has a bolt member which includes a metal inner sleeve, a metal outer sleeve fitted over the inner sleeve and made of a material which is different from that of the metal inner sleeve and which has anti-corrosion properties, and a security bar disposed axially in the inner sleeve. The lock housing assembly includes an exterior housing section with a cylindrical chamber that receives rotatably an exterior lock cylinder unit therein. The lock cylinder unit has a key-operated rotary plug with a rearwardly projecting spindle that is connected operably to the deadbolt assembly. An interior sleeve member is formed as a cylindrical wall with a front end which is secured to the rear side of the lock cylinder unit and a rear end which is formed with diametrically opposite notches. The deadbolt assembly extends through the sleeve member via the notches. A pair of bolts pass through bolt holes of an interior housing section, the mounting holes of the side plates, the front end of the sleeve member, and engage threadedly the threaded holes of the lock cylinder unit.

14 Claims, 10 Drawing Sheets

DOOR LOCK HAVING A DEADBOLT ASSEMBLY WITH A LOW-COST CORROSION-RESISTANT BOLT MEMBER

BACKGROUND OF THE INVENTION

1. Field of the Invention

The invention relates to a door lock, more particularly to a door lock which cannot be disassembled from the outer side of a door, which is easy to install and which has a deadbolt assembly with a low-cost, corrosion-resistant bolt member.

2. Description of the Related Art

FIG. 1 illustrates a door lock disclosed in U.S. Pat. No. 3,992,908. The door lock is shown to comprise a lock housing assembly (A) and a deadbolt assembly (B). The lock housing assembly (A) is to be installed in a through bore of a door (not shown), while the deadbolt assembly (B) is to be installed in an opening that is at right angles with the through bore of the door.

The lock housing assembly (A) comprises an exterior housing section (A1) with an interior sleeve extension (A11) which has a rear end formed with diametrically opposite notches (A12) that permit the extension of the deadbolt assembly (B) through the sleeve extension (A11). The sleeve extension (A11) is formed with an internal screw thread (A13). The exterior housing section (A1) has a cylindrical chamber that receives an exterior lock cylinder unit (A14) therein. The lock cylinder unit (A14) has a key-operated rotary plug (A15) with a rearwardly projecting spindle (A16).

An interior housing section (A3) may be coupled directly to the exterior housing section (A1) by means of an external screw thread (A31) thereof, or may be coupled indirectly thereto by means of an internally and externally threaded coupling sleeve (A2) which engages the thread (A13) of the sleeve extension (A11) and which further engages the thread (A31) of the interior housing section (A3).

The lock housing assembly (A) further comprises an interior cylindrical insert (A4) adapted to be received in a bore (A32) of an interior housing section (A3). An interior lock cylinder unit (A5) is contained within a chamber of the insert (A4) and has a rotary key-operated plug (A51) with a spindle (A52) that interfits telescopically the spindle (A16).

It is noted that, although the arrangement of the exterior housing section (A1) and the deadbolt assembly (B) can lock the former against rotation, the application of a great amount of torque on the exterior housing section (A1) may result in damage to the door lock, thus facilitating the disassembly of the door lock from the outer side of the door.

FIGS. 2 and 3 illustrate a deadbolt assembly disclosed in U.S. Pat. No. 4,664,433. The deadbolt assembly is shown to comprise a deadbolt casing assembly (C) and a drive arm (D). The casing assembly (C) includes a spaced pair of side plates (C1). The drive arm (D) is disposed between the side plates (C1) and has a first end formed with a cylindrical hub (D1). The cylindrical hub (D1) has two ends mounted rotatably and respectively to the side plates (C1). A pull member (E) has a rearward extension (E1) that extends into the casing assembly (C) and that is formed with a driving hole (E2). The pull member (E) is movable forwardly and rearwardly in the casing assembly (C). The second end (D2) of the drive arm (D) extends into the driving hole (E2). Forward and rearward movement of the pull member (E) occurs when the cylindrical hub (D1) is rotated by a spindle (not shown). A leaf spring (G) extends between the side plates (C1) below the drive arm (D) and defines the forward and rearward positions of the drive arm (D).

The deadbolt assembly further comprises a bolt member (F) with a forward bolt part (F1) and a rearward bolt part (F2). The forward bolt part (F1), which has a closed front end and an open rear end, further has opposite flat sides (Fll) and curved upper and lower sides (F12). The rearward bolt part (F2), which has open front and rear ends, further has a circular cross section and is telescoped by the forward bolt part (F1). The rearward bolt part (F2) is formed integrally with the pull member (E) and telescopes a hardened security bar (F3) at the front portion thereof to provide added security against transverse sawing of the bolt member (F).

The rearward bolt part (F2) has two helical slots (F21, F22) formed therein. A guide pin (F4) extends across the flat sides (F11) of the forward bolt part (F1) and passes through the helical slots (F21, F22). Relative rotation between the bolt parts (F1, F2), as guided by the guide pin (F4), would result in an increase or decrease in the total length of the bolt member (F) so as to attain a longer or shorter standard backset length.

In the bolt member (F), the forward bolt part (F1) is not fitted over the rearward bolt part (F2) to permit relative rotation therebetween. Thus, even when the forward bolt part (F1) is made of stainless steel, the rearward bolt part (F2) is still susceptible to corrosion when the deadbolt assembly is used in humid places. Of course, the bolt parts (F1, F2) may both be made of stainless steel to overcome the above drawback. However, a corresponding increase in the material cost of the bolt member (F) will be incurred.

SUMMARY OF THE INVENTION

Therefore, the objective of the present invention is to provide a door lock which cannot be disassembled from the outer side of a door, which is easy to install and which has a deadbolt assembly with a low-cost, corrosion-resistant bolt member.

Accordingly, the door lock of the present invention comprises a deadbolt assembly and a lock housing assembly.

The deadbolt assembly comprises a pull member, a bolt member, a deadbolt casing assembly and a drive arm.

The pull member has a hollow forward extension with a front end that is formed with a bar receiving hole, and a rearward extension connected to the forward extension.

The bolt member includes a metal inner sleeve, a security bar, and a metal outer sleeve. The inner sleeve has a front wall with a through-hole formed therethrough, and an open rear end which is sleeved on and which is secured to the forward extension of the pull member. The security bar is made of a high-strength metal material and has a shank portion which extends into the inner sleeve via the through-hole in the front wall of the inner sleeve. The shank portion has a tip which extends into the bar receiving hole of the forward extension. The outer sleeve is made of a material which is different from that of the inner sleeve and which has anti-corrosion properties. The outer sleeve has a closed front end and an open rear end. The inner sleeve is inserted fittingly into the outer sleeve via the open rear end of the outer sleeve.

The deadbolt casing assembly includes a bolt casing and a pair of spaced side plates. The bolt casing receives the bolt member slidably therein and has an open rear end to permit extension of the forward extension of the pull member therein. The side plates are formed with a pair of mounting holes and have front ends connected to the open rear end of the bolt casing. The side plates further have inner wall surfaces formed with a respective boss between the mounting holes. The rearward extension of the pull member rests slidably on each boss and is movable forward and rearward relative to the side plates.

The drive arm is disposed between the side plates and has a first end which is mounted rotatably to the boss of each of the side plates and which is formed with a spindle hole, and a second end which engages operably the rearward extension of the pull member.

The lock housing assembly includes an exterior housing section, an interior sleeve member, and an interior housing section.

The exterior housing section has a cylindrical chamber that receives rotatably an exterior lock cylinder unit therein. The lock cylinder unit has a key-operated rotary plug with a rearwardly projecting spindle. The lock cylinder unit further has a rear side formed with a pair of threaded holes.

The interior sleeve member is formed as a cylindrical wall with a front end which is secured to the rear side of the lock cylinder unit and a rear end which is formed with diametrically opposite notches. The deadbolt assembly extends through the sleeve member via the notches. The spindle extends through the front end of the sleeve member and into the sleeve member to engage the spindle hole of the drive arm.

The interior housing section is formed with a pair of bolt holes. A pair of bolts pass through the bolt holes of the interior housing section, the mounting holes of the side plates, the front end of the sleeve member, and engage threadedly the threaded holes of the lock cylinder unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
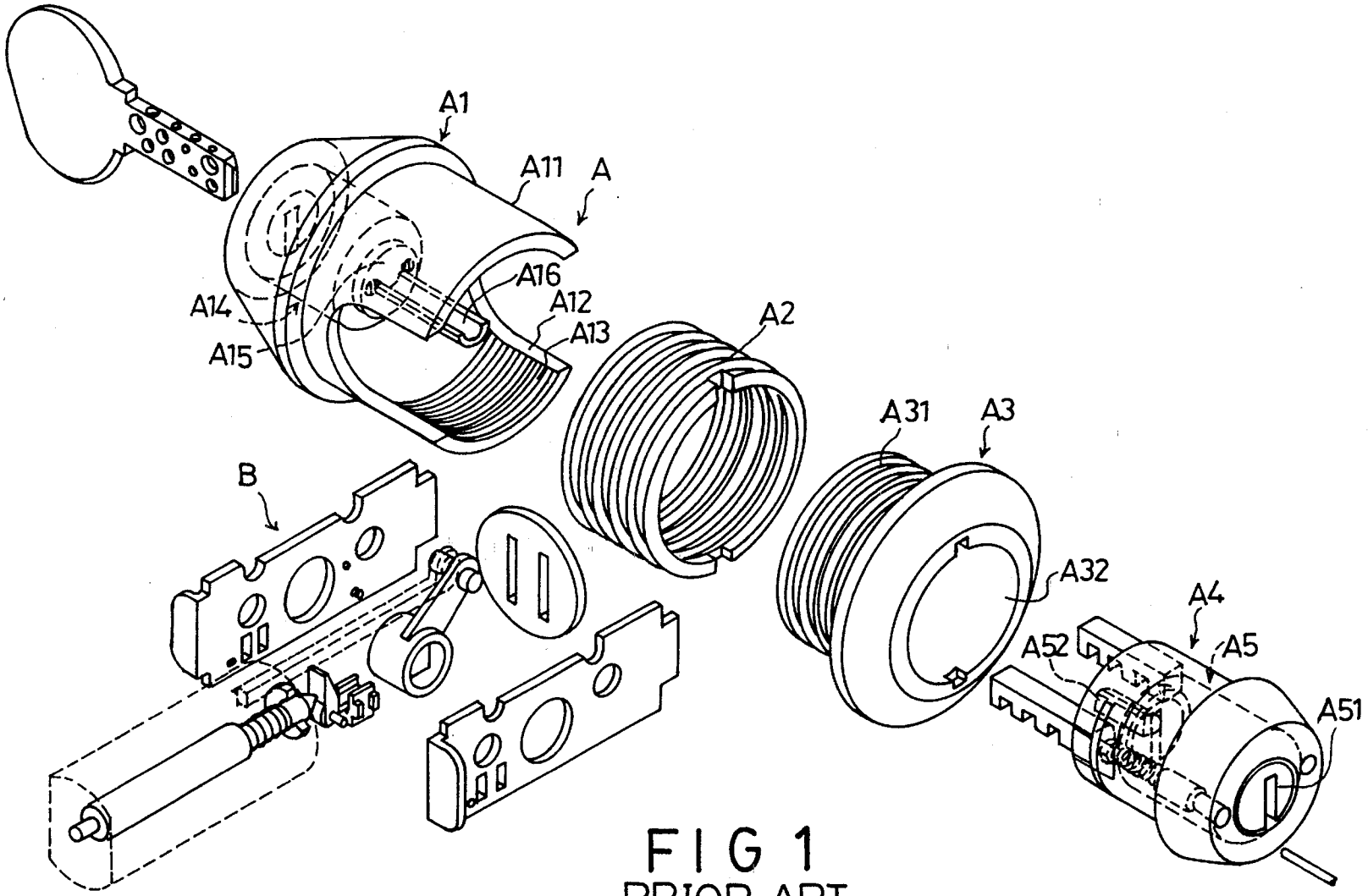
FIG 1 PRIOR ART
FIG. 1 is an exploded view of a conventional door lock disclosed in U.S. Pat. No. 3,992,908.
Figure 2:
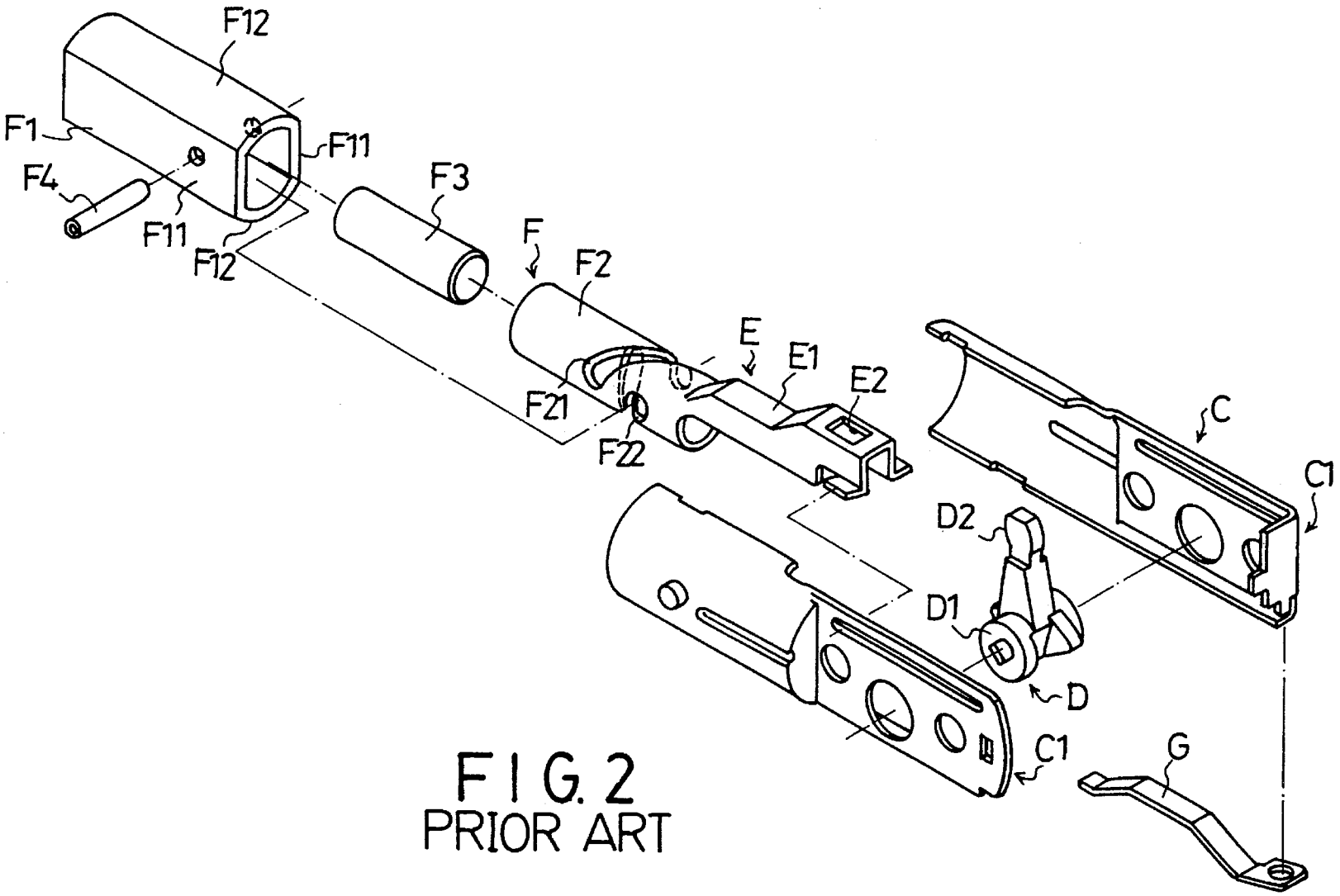
FIG. 2 PRIOR ART
FIG. 2 is an exploded view of a conventional deadbolt assembly disclosed in U.S. Pat. No. 4,664,433.
Figure 3:
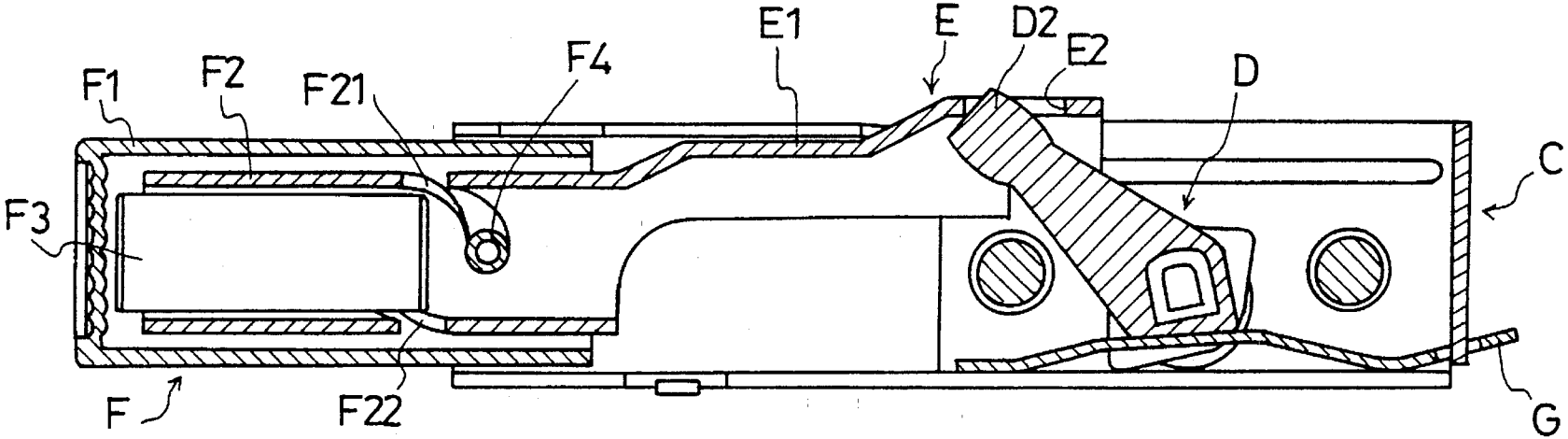
FIG. 3 PRIOR ART
FIG. 3 is a sectional view illustrating the operation of the conventional deadbolt assembly shown in FIG. 2.
Figure 4:
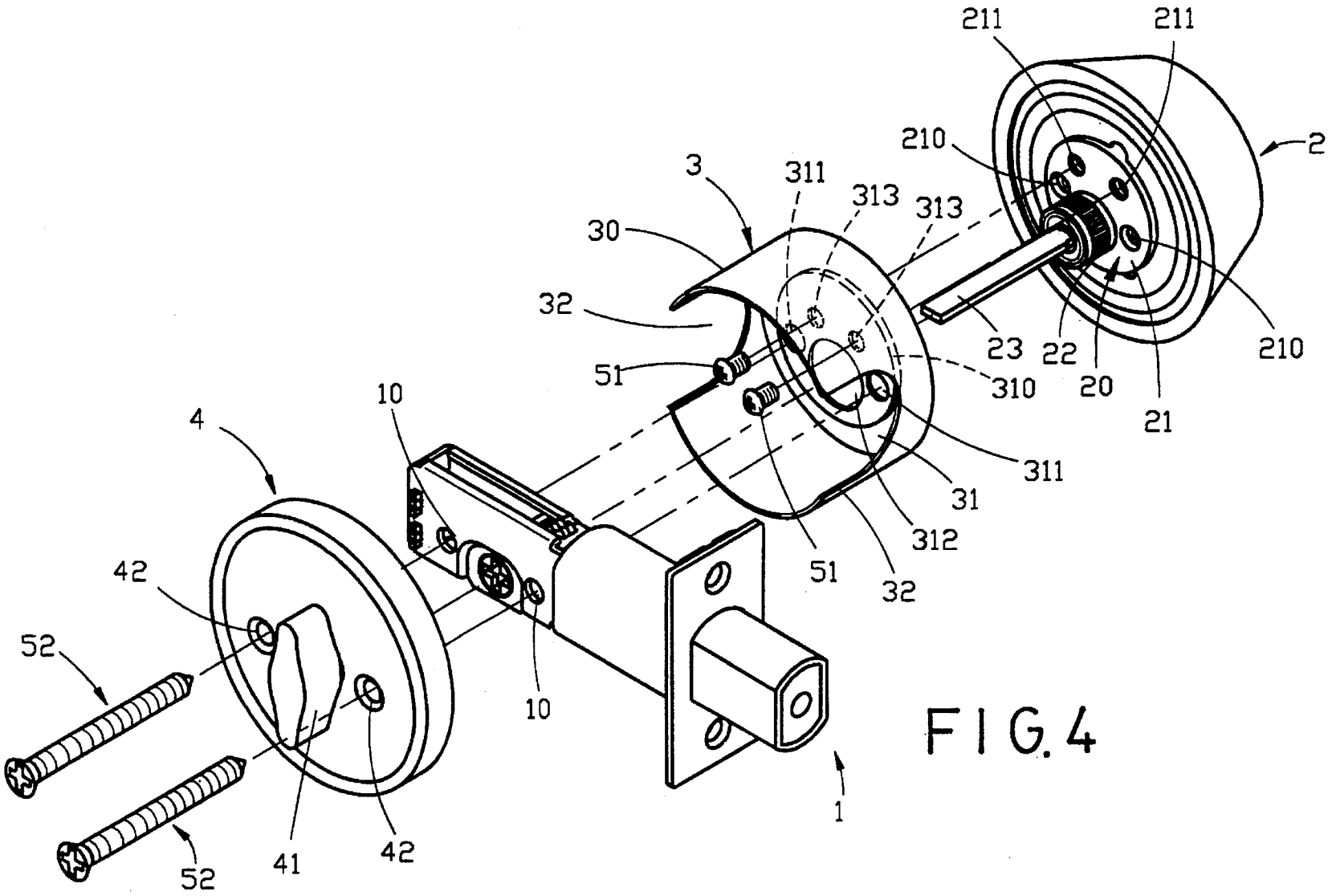
FIG. 4 is a partly exploded view of the preferred embodiment of a door lock according to the present invention.
Figure 5:
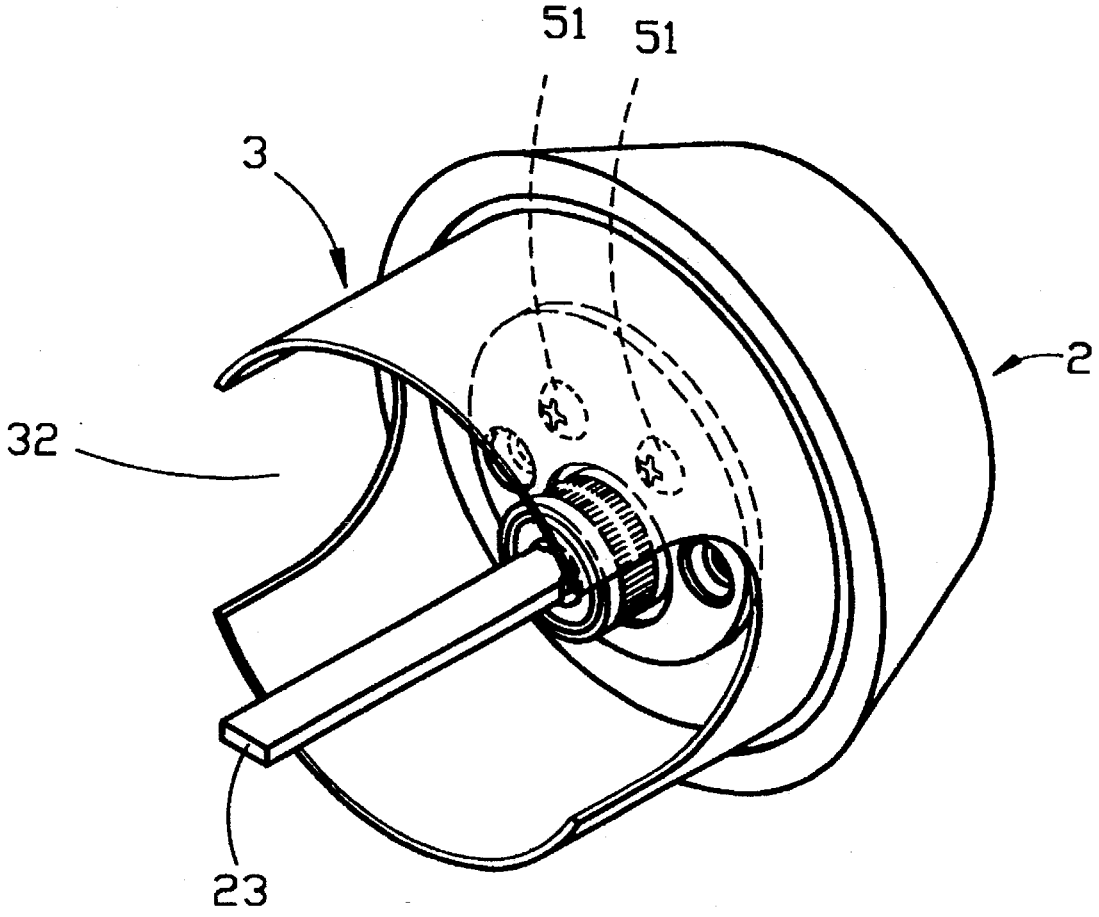
FIG. 5 is a perspective view illustrating an exterior housing section and an interior sleeve member of the preferred embodiment.

Referring to FIGS. 4 and 5, the preferred embodiment of a door lock according to the present invention is shown to comprise a lock housing assembly and a deadbolt assembly 1. The lock housing assembly is to be installed in a through bore of a door (not shown), while the deadbolt assembly 1 is to be installed in an opening that is at right angles with the through bore of the door.

The lock housing assembly comprises an exterior housing section 2, an interior sleeve member 3, and an interior housing section 4. The interior sleeve member 3 is formed as a cylindrical wall 30 with a front end which is provided with a mounting plate 31 and a rear end which is formed with diametrically opposite notches 32 that permit the extension of the deadbolt assembly 1 through the sleeve member 3. The mounting plate 31 is formed with a central depression 310, a pair of diametrically opposite first through-holes 311, a second through-hole 312 between the first through-holes 311, and a pair of third through-holes 313 adjacent the second through-hole 312. The third through-holes 313 permit the extension of two screws 51 therethrough.

The exterior housing section 2 has a cylindrical chamber that receives rotatably an exterior lock cylinder unit 20 therein. The lock cylinder unit 20 has a key-operated rotary plug 22 with a rearwardly projecting spindle 23. The lock cylinder unit 20 has a bottom side 21 which extends into the depression 310 and which is formed with a pair of first threaded holes 210 aligned with the first through-holes 311, and a pair of second threaded holes 211 aligned with the third through-holes 313. The second through-hole 312 of the interior sleeve member 3 permits the extension of the spindle 23 therethrough to enable the latter to engage operably the deadbolt assembly 1. The screws 51 engage threadedly the second threaded holes 211 to secure the sleeve member 3 to the lock cylinder unit 20, as shown in FIG. 5.

Due to the presence of the notches 32 in the sleeve member 3, the first threaded holes 210 of the lock cylinder unit 20 can be easily aligned with a pair of mounting holes 10 of the deadbolt assembly 1, thereby facilitating installation of the door lock of the present invention.

In this embodiment, the interior housing section 4 is formed with a pair of bolt holes 42 and a rotary knob 41 for operating the deadbolt assembly 1 from the inner side of the door in a known manner. A pair of bolts 52 pass through the bolt holes 42 of the interior housing section 4, the mounting holes 10 of the deadbolt assembly 1, the first through-holes 311 of the sleeve member 3, and engage threadedly the first threaded holes 210 of the lock cylinder unit 20. This illustrates how the door lock of the present invention is secured to a door.

In the present invention, the exterior housing section 2 is capable of rotating freely relative to the lock cylinder unit 20. Because the interior sleeve member 3 is secured to the lock cylinder unit 20 instead of the exterior housing section 2, the door lock of this invention is not damaged even when a great amount of torque is applied on the exterior housing section 2.

It is noted that the arrangement of the holes 311, 312 and 313 of the sleeve member 3 should not be limited to that described beforehand. For example, the arrangement of the holes 311, 312 and 313 may be modified, such as by intercommunicating the holes 311, 312, 313, without affecting the purpose of the sleeve member 3.

Figure 6:
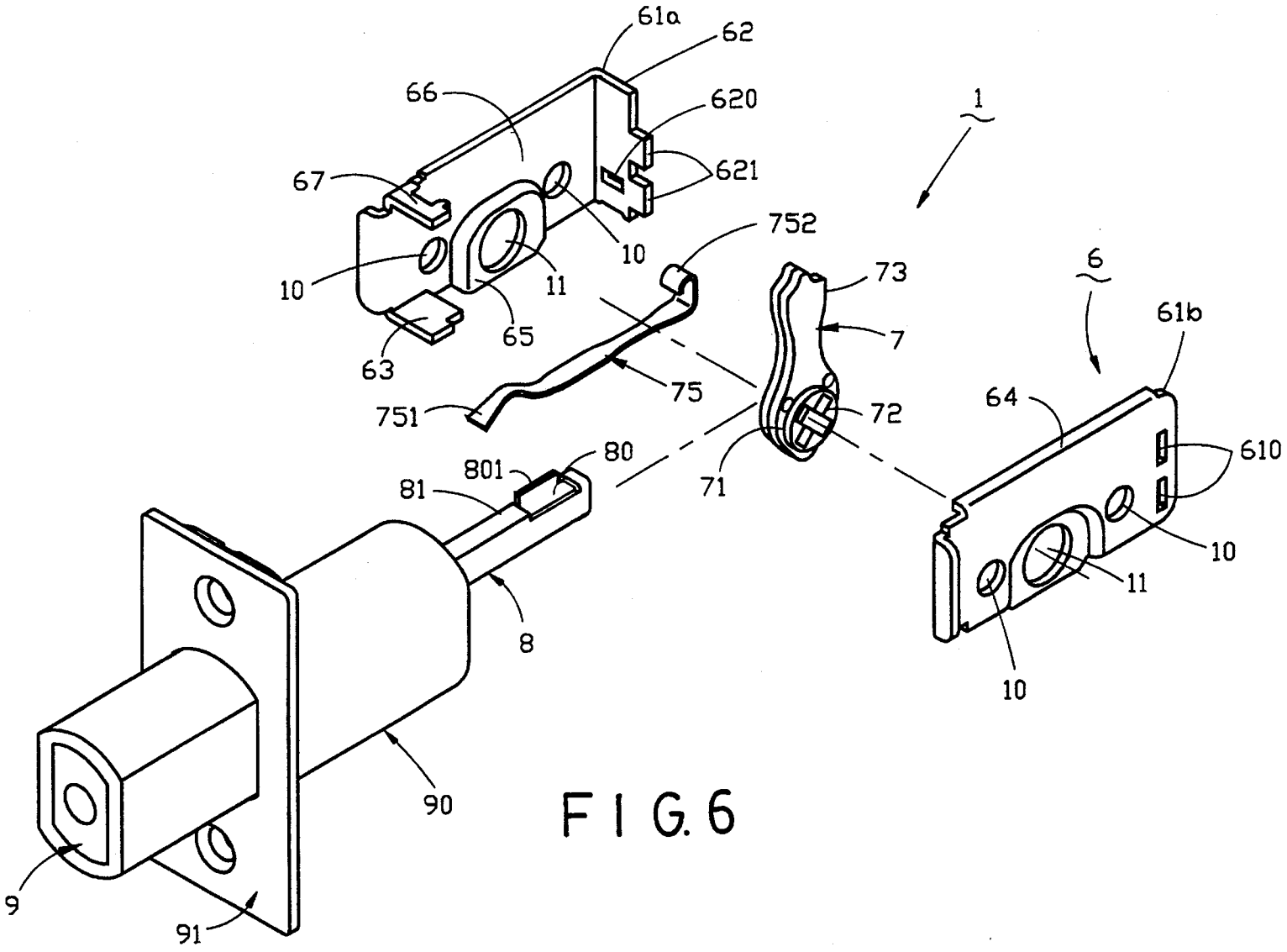
FIG. 6 is a partly exploded view of a deadbolt assembly of the preferred embodiment.
Figure 7:
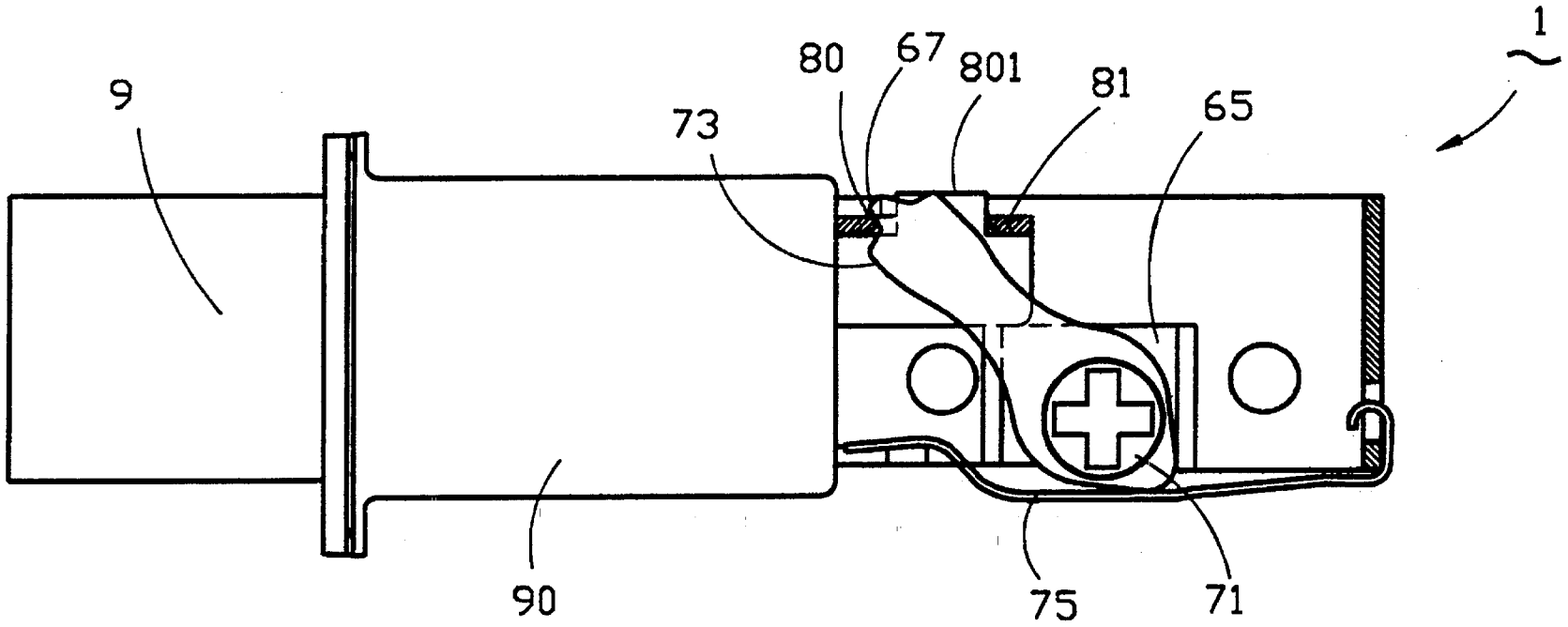
FIG. 7 is a partly sectional view of the deadbolt assembly with a bolt member thereof being shown in a fully extended position.
Figure 8:
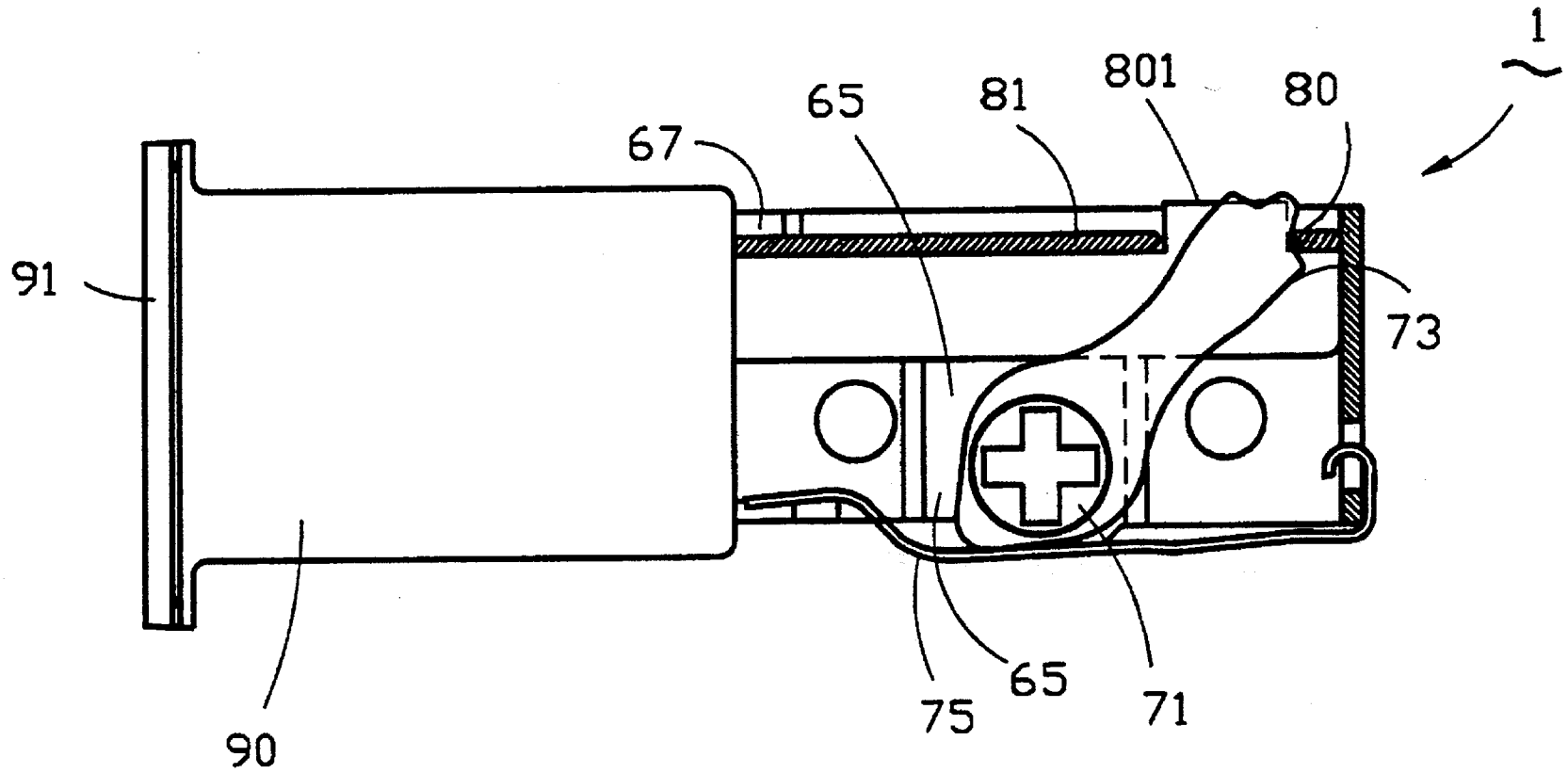
FIG. 8 is a partly sectional view of the deadbolt assembly with the bolt member thereof being shown in a fully retracted position.

Referring to FIGS. 6 to 8, the deadbolt assembly 1 is shown to comprise a deadbolt casing assembly 6, a drive arm 7, a pull member 8 and a bolt member 9. The casing assembly 6 includes a pair of side plates 61*a*, 61*b*, the front ends of which are connected to the open rear end of a bolt casing 90. The bolt casing 90, which receives the bolt member 9 slidably therein, has an open front end with a face plate 91 mounted thereto. The face plate 91 is to be connected to a vertical edge of a door in a known manner. The rear end of one of the side plates 61*a* is provided with a folded extension 62 that is bent toward the other one of the side plates 61*b* and that is formed with a pair of lugs 621 which engage a pair of openings 610 formed in the rear end of the other one of the side plates 61*b*, thereby connecting spacedly the side plates 61*a*, 61*b*. The side plates 61*a*, 61*b* are formed with the mounting holes 10 which permit the extension of the bolts 52 therethrough (see FIG. 4). In this embodiment, the side plate 61*b* has a top edge formed with an inwardly projecting flange 64. Each of the side plates 61*a*,61*b* further has an inner wall surface that is formed with a boss 65 between the mounting holes 10. The boss 65 has a top surface which is spaced from the top edge of the side plates 61*a*, 61*b* and which, by itself or in cooperation with the flange 64, provides a guideway 66 for the pull member 8. The boss 65 is formed with a hub receiving hole 11.

The drive arm 7 is disposed between the side plates 61*a*, 61*b* and has one end formed with a cylindrical hub 71. The cylindrical hub 71 has two ends which extend rotatably into the receiving hole 11 of the respective side plate 61*a*, 61*b*. The cylindrical hub 71 is formed with a spindle hole 72 which permits the extension of the spindle 23 therethrough (see FIG. 4).

The pull member 8 has a forward extension 82 that extends into the bolt casing 90 and that is connected to the bolt member 9 (see FIG. 9), and a rearward extension 81 that extends between the side plates 61*a*, 61*b* and that is formed with a driving hole 80. The rearward extension 81 extends slidably into the guideways 66 of the side plates 61*a*, 61*b*. That is, the rearward extension 81 rests slidably on the bosses 65 to ensure proper forward and rearward movement of the rearward extension 81 relative to the side plates 61*a*, 61*b*. The other end 73 of the drive arm 7 extends into the driving hole 72. Forward and rearward movement of the pull member 8 occurs when the cylindrical hub 71 is rotated by the spindle 23. A leaf spring 75 is formed as a resilient strip with a front support portion 751 and a rear hook portion 752. The leaf spring 75 extends between the side plates 61*a*, 61*b* below the drive arm 7. The front support portion 751 of the leaf spring 75 rests on a transverse support beam 63 of one of the side plates 61*a*, while the rear hook portion 752 engages a slit 620 in the folded extension 62. The hub 71 rests on an intermediate portion of the leaf spring 75. The leaf spring 75 serves to define the forward and rearward positions of the drive arm 7 to define correspondingly extended and retracted positions of the bolt member 9, as shown in FIGS. 7 and 8.

The flange 64 of the side plate 61*b* cooperates with the other side plate 61*a* to define a guide slot therebetween. The top edge of the side plate 61*a* is further formed with a stop flange 67 that extends toward the other side plate 61*b* and that is disposed adjacent to the front ends of the side plates 61*a*, 61*b*. The driving hole 80 of the pull member 8 is a rectangular hole with two longitudinal edges, one of which is formed with an upwardly projecting limit flange 801 that extends into the guide slot. The limit flange 801 and the stop flange 67 cooperate to prevent removal of the pull member 8 and the bolt member 9 via the open front end of the bolt casing 90.

Figure 9:
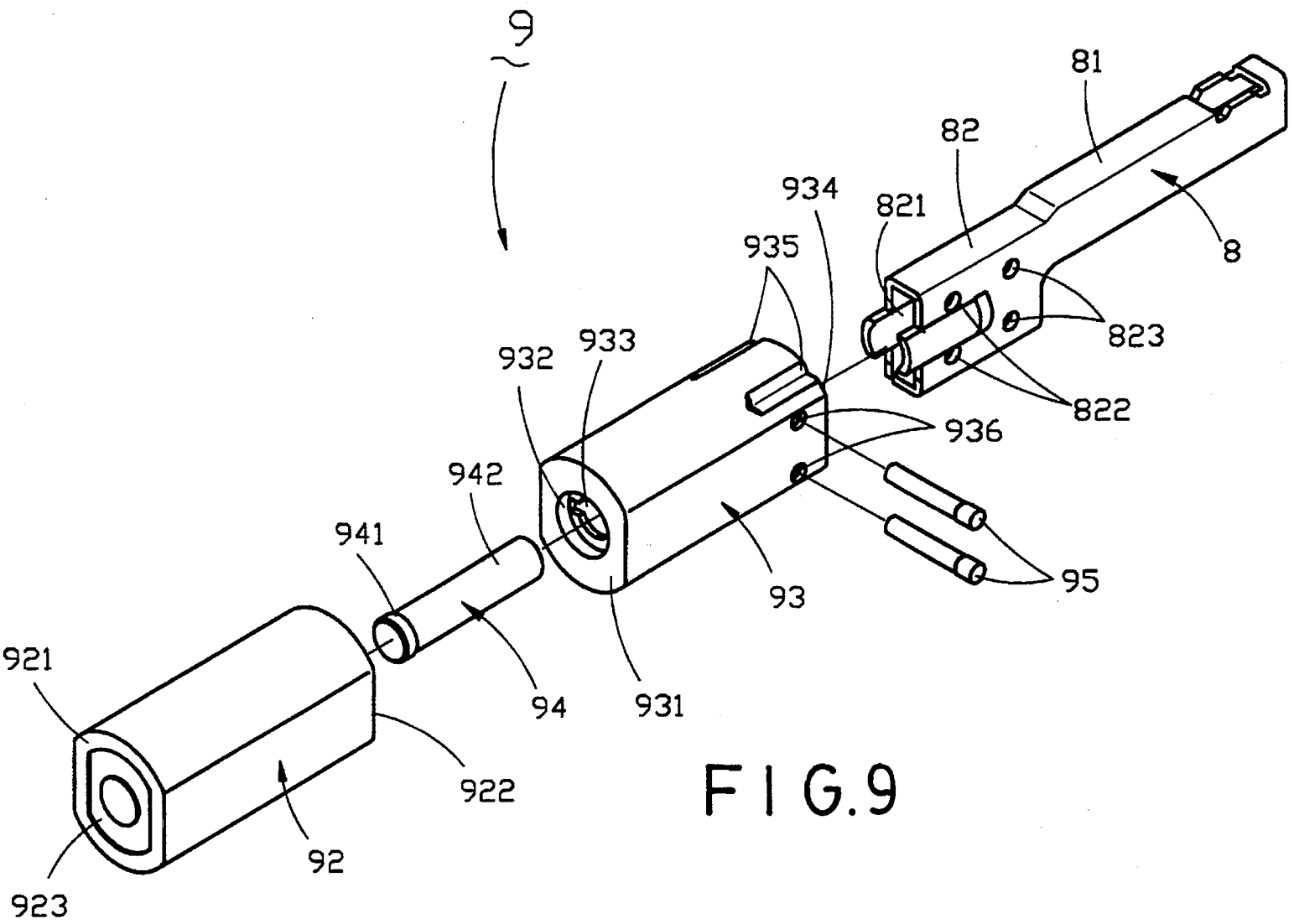
FIG. 9 illustrates an exploded view of the bolt member of the preferred embodiment.
Figure 10:
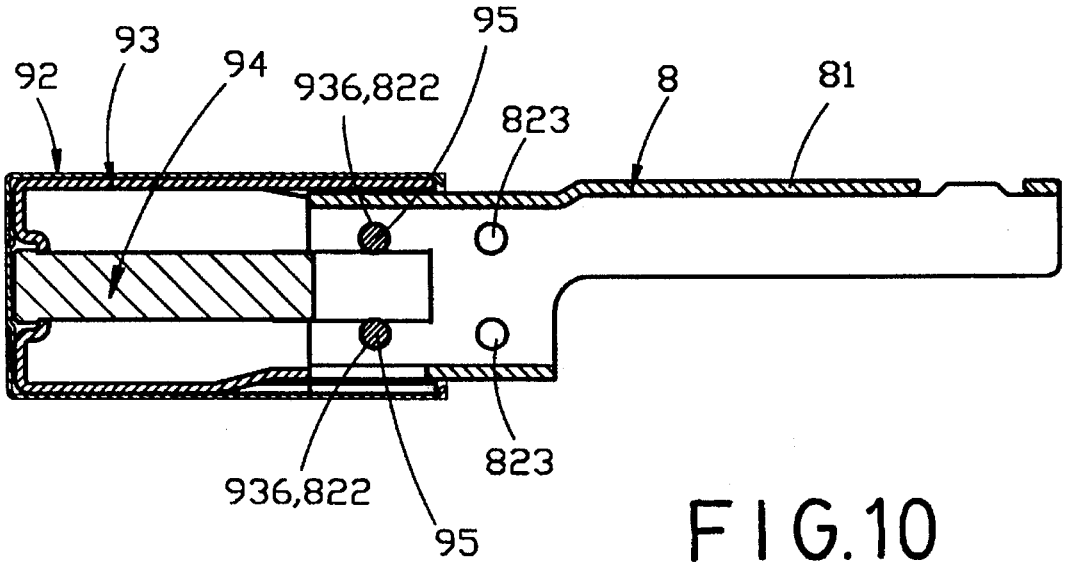
FIG. 10 is a sectional view of the bolt member when assembled to a pull member at a longer backset length.
Figure 11:
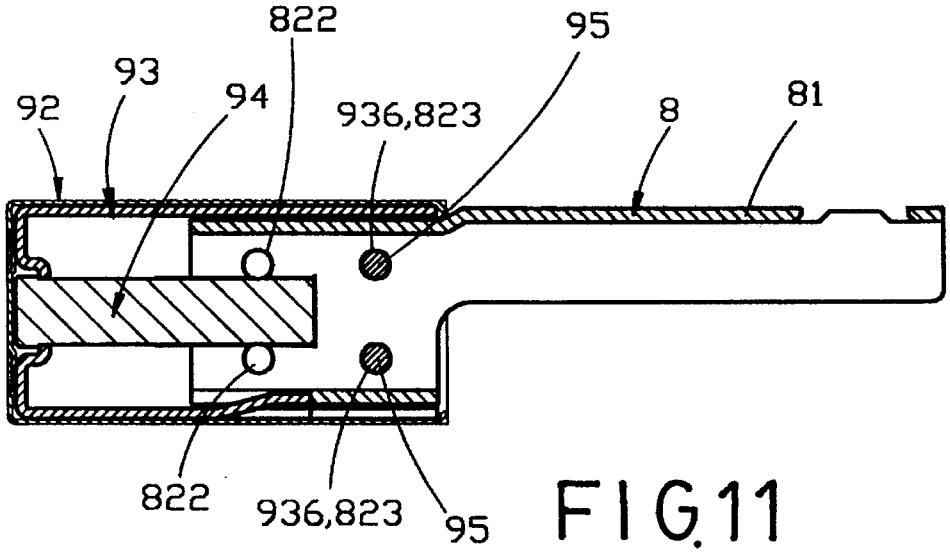
FIG. 11 is a sectional view of the bolt member when assembled to the pull member at a shorter backset length.

Referring to FIGS. 9 to 11, the bolt member 9 is shown to comprise a metal outer sleeve 92, a metal inner sleeve 93 and a security bar 94.

The outer sleeve 92 is made of a metal material with anti-corrosion properties, such as stainless steel, and is made from a metal sheet through conventional sheet forming techniques. The outer sleeve 92, which has a closed front end 921 and an open rear end 922, further has opposite flat sides and curved upper and lower sides.

The inner sleeve 93 is made of a metal material which is different from that of the outer sleeve 92, such as zinc alloy or copper, and is similarly made from a metal sheet through known sheet forming techniques. The inner sleeve 93 further has a cross section similar to that of the outer sleeve 92 and is inserted fittingly in the latter via the open rear end 922 of the outer sleeve 92. The inner sleeve 93 has a front wall 931 that is formed with a circular recess 932 and a through-hole 933 at an innermost end of the circular recess 932. The inner sleeve 93 further has an open rear end 934 which is sleeved on the forward extension 82 of the pull member 8. The periphery of the open rear end 934 is formed with a number of inward positioning ribs 935 and two pin receiving holes 936.

The forward extension 82 of the pull member 8 is hollow and is generally rectangular in cross section. The forward extension 82 has an open front end 821 with a longitudinally extending bar receiving hole. The forward extension 82 further has at least one side wall formed with first and second pin hole sets 822, 823. The first pin hole set 822 is disposed closer to a front distal end of the forward extension 82 than the second pin hole set 823.

The positioning ribs 935 guide the movement of the forward extension 82 into the inner sleeve 93 when the forward extension 82 is inserted into the open rear end 934 of the latter. When inserted, the pin receiving holes 936 of the inner sleeve 93 are aligned with the first pin hole set 822 to obtain a bolt member with a longer backset length, as shown in FIG. 10. Alternatively, the pin receiving holes 936 of the inner sleeve 93 may be aligned with the second pin hole set 823 to obtain a bolt member with a shorter backset length, as shown in FIG. 11. A pair of pins 95 extend through the pin receiving holes 936 and the selected one of the first and second pin hole sets 822, 823 to secure the inner sleeve 93 to the forward extension 82.

The security bar 94 is formed as a cylindrical bar and is made of a high-strength metal material, such as high-carbon steel. The security bar 94 has a head portion 941 which is received in the circular recess 932 in the front wall 931 of the inner sleeve 93, and a shank portion 942 which extends into the inner sleeve 93 via the through-hole 933. Preferably, the tip of the shank portion 942 extends into the bar receiving hole in the open front end 821 of the forward extension 82 and is retained rotatably thereby so as to provide added security against transverse sawing of the bolt member 9.

In this embodiment,the front end 921 of the outer sleeve 92 is punched so as to form a retaining groove 923 that engages the head portion 941 of the security bar 94.

After the inner sleeve 93 and the security bar 94 have been assembled into the outer sleeve 92, the periphery of the open rear end 922 of the outer sleeve 92 is folded to engage the periphery of the open rear end 934 of the inner sleeve 93, thereby preventing the disengagement of the inner sleeve 93 from the outer sleeve 92.

Since the outer sleeve 92, which is made of a metal material with excellent anti-corrosion properties, is fitted over the inner sleeve 93, the outer sleeve 92 can provide adequate protection to the inner sleeve 93 against corrosion. Thus, the inner sleeve 93 does not corrode easily even when it is made of an inexpensive metal with poor anti-corrosion properties.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

We claim:

1. A deadbolt assembly comprising: a pull member having a hollow forward extension with a front end that is formed with a bar receiving hole; and a bolt member including: a metal inner sleeve having a front wall with a through-hole formed therethrough, and an open rear end which is sleeved on and which is secured to said forward extension of said pull member; a security bar made of a high-strength metal material and having a shank portion which extends into said inner sleeve via said through-hole in said front wall of said inner sleeve, said shank portion having a tip which extends into said bar receiving hole of said forward extension; and a metal outer sleeve made of a material which is different form that of said inner sleeve and which has anti-corrosion properties, said outer sleeve having a closed front end and an open rear end, said inner sleeve being inserted fittingly into said outer sleeve via said open rear end of said outer sleeve; wherein said front wall of said inner sleeve is formed with a recess, said through-hole in said front wall of said inner sleeve being formed at an innermost end of said recess, said security bar having a head portion received in said recess.

2. The deadbolt assembly as claimed in claim 1, wherein said inner and outer sleeves have opposite flat sides and curved upper and lower sides.

3. The deadbolt assembly as claimed in claim 1, wherein said closed front end of said outer sleeve is formed with a retaining groove that engages said head portion of said security bar.

4. The deadbolt assembly as claimed in claim 1, wherein said open rear end of said outer sleeve has a folded periphery which engages a periphery of said open rear end of said inner sleeve to prevent disengagement of said inner sleeve from said outer sleeve.

5. The deadbolt assembly as claimed in claim 1, wherein said forward extension further has at least one side wall formed with first and second pin holes, said first pin hole being disposed closer to a front distal end of said forward extension than said second pin hole, said inner sleeve being formed with a pin receiving hole to be aligned selectively with one of said first and second pin holes, said deadbolt assembly further comprising a pin which extends through said pin receiving hole and the selected one of said first and second pin holes to secure said inner sleeve to said forward extension.

6. The deadbolt assembly as claimed in claim 1, wherein said security bar is made of high-carbon steel.

7. The deadbolt assembly as claimed in claim 1, wherein said outer sleeve is made of stainless steel.

8. A deadbolt assembly, comprising:

a bolt member;

a pull member having a forward extension connected to said bolt member, and a rearward extension connected to said forward extension;

a deadbolt casing assembly including: a bolt casing for receiving said bolt member slidably therein, said bolt casing having an open rear end to permit extension of said forward extension of said pull member therein; and a pair of spaced side plates formed with a pair of mounting holes and having front ends connected to said open rear end of said bolt casing, said side plates further having inner wall surfaces formed with a respective boss between said mounting holes, said rearward extension of said pull member resting slidably on each said boss and being movable forward and rearward relative to said side plates; and a drive arm disposed between said side plates, said drive arm having a first end mounted rotatably to said boss of each of said side plates and formed with a spindle hole, said drive arm further having a second end which engages operably said rearward extension of said pull member.

9. The deadbolt assembly as claimed in claim 8, wherein said boss is formed with a hub receiving hole, and said first end of said drive arm is formed as a cylindrical hub with two ends that extend rotatably into said hub receiving hole of a respective said boss.

10. The deadbolt assembly as claimed in claim 9, further comprising a leaf spring which extends between said side plates below said drive arm for defining forward and rearward positions of said drive arm to define correspondingly extended and retracted positions of said bolt member.

11. The deadbolt assembly as claimed in claim 8, wherein said rearward extension of said pull member is formed with limit means for preventing removal of said pull member and said bolt member through said bolt casing.

12. The deadbolt assembly as claimed in claim 11, wherein said rearward extension of said pull member is formed with a rectangular driving hole for engaging said second end of said drive arm, said driving hole having opposite longitudinal edges, said limit means including an upwardly projecting limit flange formed on at least one of said longitudinal edges.

13. The deadbolt assembly as claimed in claim 12, wherein one of said side plates is further formed with a stop flange that extends toward the other one of said side plates and that is disposed adjacent to said front ends of said side plates, said stop flange cooperating with said limit flange to prevent removal of said pull member and said bolt member through said bolt casing.

14. The deadbolt assembly as claimed in claim 13, wherein at least one of said side plates has a top edge formed with an inwardly projecting flange.

* * * * *